US005819608A

United States Patent [19]

Hsieh

[11] Patent Number: 5,819,608

[45] **Date of Patent: *Oct. 13, 1998**

[54] THREADLESS CRESCENT WRENCH

[76] Inventor: Chih-Ching Hsieh, No. 64,Lane 107, Liang Tsun Rd., Fong Yuan City, Taichung Hsien, Taiwan

[ * ] Notice: The term of this patent shall not extend beyond the expiration date of Pat. No. 5,799,550.

[21] Appl. No.: 788,415

[22] Filed: Jan. 27, 1997

[51] Int. Cl.[6] ..... B25B 13/34

[52] U.S. Cl. ..... 81/150; 81/151

[58] Field of Search ..... 81/128, 129, 150, 81/151

[56] References Cited

U.S. PATENT DOCUMENTS

| | | | |
|---|---|---|---|
| 696,406 | 4/1902 | Breul | 81/150 |
| 2,829,551 | 4/1958 | Kupis | 81/151 |

FOREIGN PATENT DOCUMENTS

| | | | |
|---|---|---|---|
| 166693 | 7/1921 | United Kingdom | 81/151 |
| 2240502 | 8/1991 | United Kingdom | 81/151 |

*Primary Examiner*—James G. Smith
*Attorney, Agent, or Firm*—Varndell Legal Group

[57] ABSTRACT

A crescent wrench including a steel ball mounted in a recessed hole in a movable jaw and forced by a spring into engagement with the periphery of a cylindrical control member, which is turned about an axis in an opening in a handle, which has a front end terminating in a fixed jaw, the cylindrical control member having a longitudinal groove adapted for receiving the steel ball for permitting the movable jaw to be released from the constraint of the cylindrical control member, and two longitudinal finger ribs for turning by hand to let the steel ball be moved into the longitudinal groove of the cylindrical control member, or forced out of the longitudinal groove and into engagement with the periphery of the cylindrical control member.

1 Claim, 6 Drawing Sheets

THREADLESS CRESCENT WRENCH

BACKGROUND AND SUMMARY OF THE INVENTION

The present invention relates to crescent wrenches, and more specifically to a threadless crescent wrench which uses a cylindrical control member turned to release or hold down the movable jaw, permitting the movable jaw to be adjusted to the desired position relative to the fixed jaw.

FIG. 1 shows a crescent wrench according to the prior art. This structure of crescent wrench is comprised of a handle having a front end terminating in a fixed jaw, a thumb screw mounted in an opening in the handle near the front end, a movable jaw meshed with the thumb screw and moved by it relative to the fixed jaw. This structure of crescent wrench is still not satisfactory in function. When the crescent wrench is attached to the workpiece after the movable jaw has been adjusted to the desired position, the movable jaw tends to displace, causing the crescent wrench unable to be positively attached to workpiece. If the movable jaw is moved inwards after adjustment, the mouth between the movable jaw and fixed jaw becomes too small to be attached to the workpiece, and the movable jaw shall have to be adjsuted again.

The present invention has been accomplished to provide a crescent wrench which eliminates the aforesaid problem. According to the preferred embodiment of the present invention, the threadless crescent wrench comprises a cylindrical control member turned about an axis in an opening in a handle and having a longitudinal groove, a movable jaw moved relative to a fixed jaw at the front end of the handle, a steel ball supported on a spring in a recessed hole in the movable jaw and forced by the spring into engagement with the periphery of the cylindrical control member. When the steel ball is forced into engagement with the periphery of the cylindrical control member, the movable jaw is fixed. When the cylindrical control member is turned by fingers to let the steel ball be moved into the longitudinal groove of the cylindrical control member, the movable jaw is released, and can be moved with the thumb relative to the fixed jaw.

DETAILED DESCRIPTION OF THE PREFERRED EMBODIMENT

Figure 1:
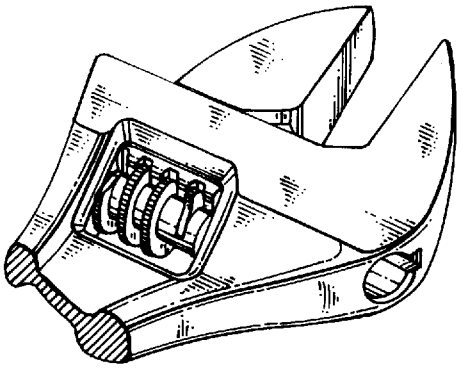
Fig. 1 PRIOR ART
FIG. 1 shows the structure of a crescent wrench according to the prior art.
Figure 2:
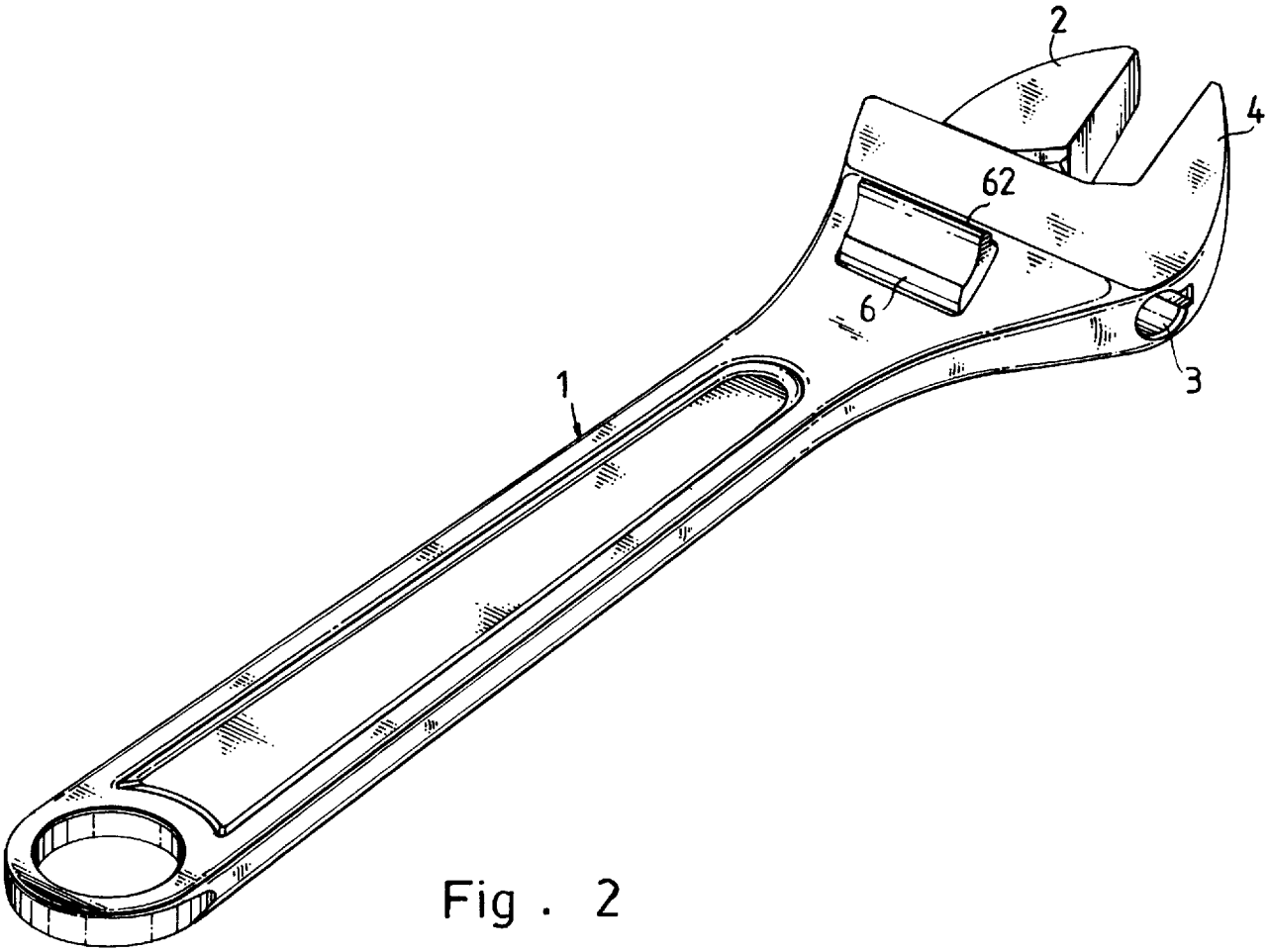
FIG. 2 is an elevational view of a threadless crescent wrench according to the present invention.
Figure 3:
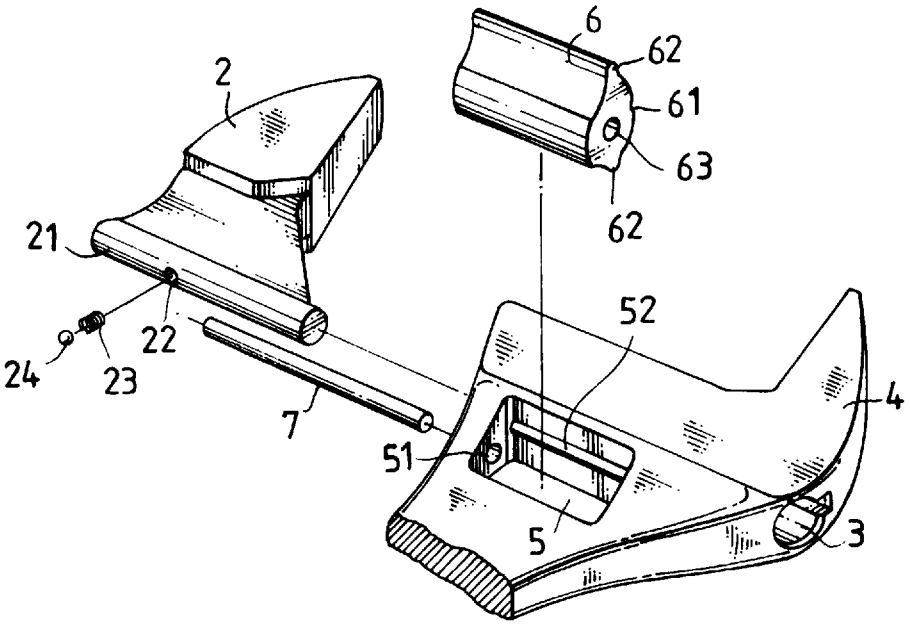
FIG. 3 is an exploded view of the threadless crescent wrench shown in FIG. 2.

Referring to Figures from 2 to 5, a crescent wrench in accordance with the present invention is generally comprised of a handle 1 having a front end terminating in a fixed jaw 4, a cylindrical control member 6, a spring 23, a steel ball 24, a movable jaw 2, and a pivot 7.

The handle 1 has an opening 5 near the front end, a transverse sliding hole 3 disposed between the fixed jaw 4 and the opening 5, a transverse slot 52 communicating between the opening 5 and the transverse sliding hole 3, two pivot holes 51 at two opposite sides of the opening 5. The cylindrical control member 6 is mounted within the opening 5 and turned about an axis, having a longitudinal center through hole 63, a longitudinal groove 61 at the periphery, and two longitudinal finger ribs 62 raised from the periphery at two opposite sides. The pivot 7 is fitted into the longitudinal center through hole 63 of the cylindrical control member 6, having two opposite ends respectively and revolvably inserted into the pivot holes 51 of the handle 1. The movable jaw 2 is moved relative to the fixed jaw 4 of the handle 1, having a cylindrical coupling portion 21 moved in the transverse sliding hole 3 of the handle 1, and a recessed hole 22 at the periphery. The spring 23 is mounted in the recessed hole 22. The steel ball 24 is supported on the spring 23, and forced by it into engagement with the longitudinal groove 61 of the cylindrical control member 6.

Figure 4:
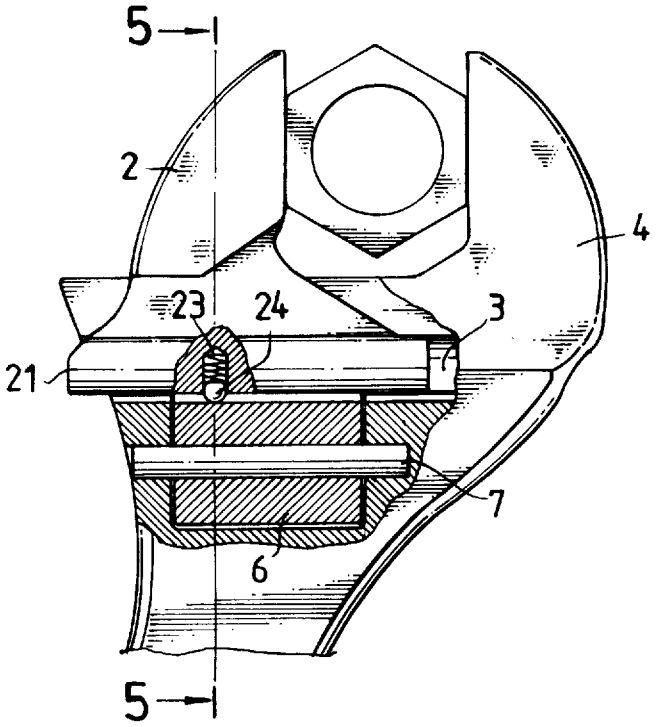
FIG. 4 is a top view in section in an enlarged scale of a part of the threadless crescent wrench shown in FIG. 2.
Figure 5:
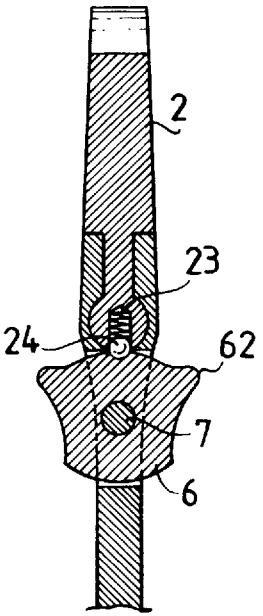
FIG. 5 is a sectional view taken along line 5—5 of FIG. 4.
Figure 6:
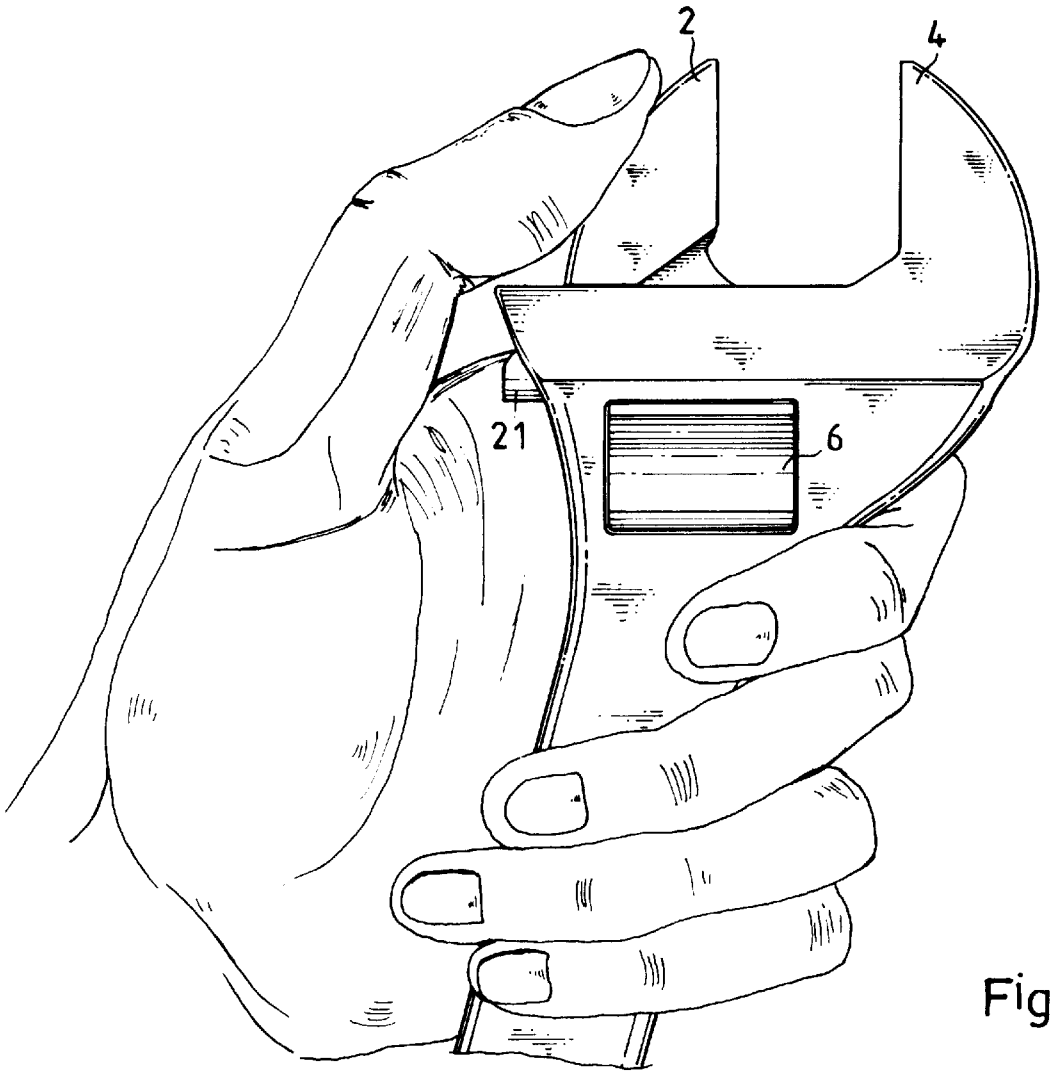
FIG. 6 is an applied view of the present invention, showing the crescent wrench operated.
Figure 7:
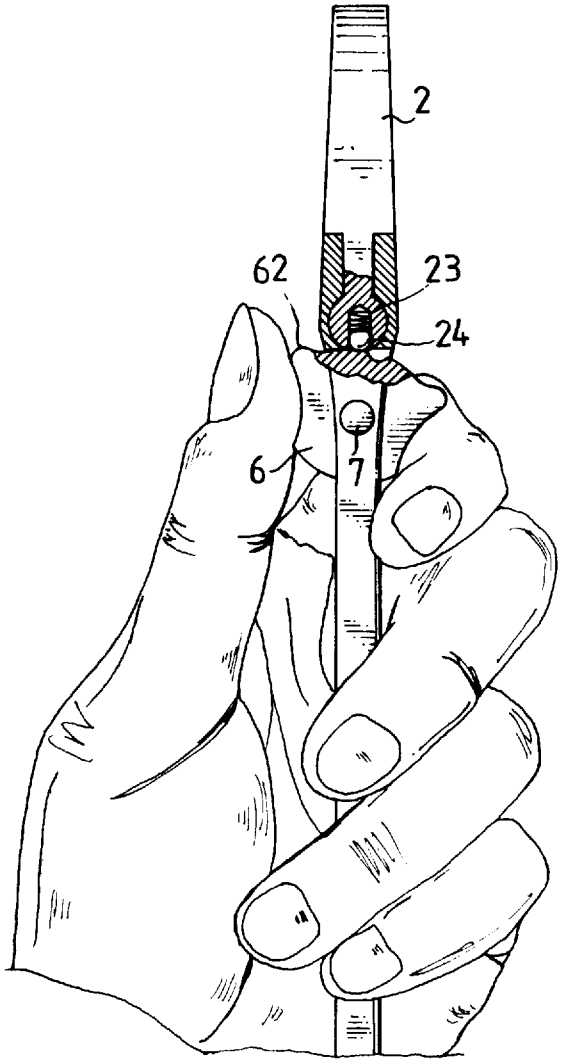
FIG. 7 is a sectional view of the present invention, showing the steel ball moved out of the longitudinal groove of the cylindrical control member, and the movable jaw firmly retained in position.

Referring to FIGS. 6 and 7 and FIG. 4 again, through the finger ribs 62, the cylindrical control member 6 can be turned within the opening 5 relative to the steel ball 24, causing the steel ball 24 to be moved into or out of the longitudinal groove 61 of the cylindrical control member 6. When the steel ball 24 is moved into the longitudinal groove 61 of the cylindrical control member 6, the movable jaw 2 can then be moved with the thumb relative to the fixed jaw 4. When the movable jaw 2 is moved to the desired position, the cylindrical control member 6 is turned reversely to force the steel ball 24 out of the longitudinal groove 61 of the cylindrical control member 6, causing the steel ball 24 to engage the periphery of the movable jaw 2, and therefore the movable jaw 2 is firmly retained in position.

I claim:

1. A crescent wrench comprising a handle having a front end terminating in a fixed jaw, a movable jaw moved relative to said fixed jaw and adapted to match with said fixed jaw for turning things, and a release and constraint control mechanism controlled to lock said movable jaw at the desired position, wherein:

said handle comprises an opening near the front end, a transverse sliding hole disposed between said fixed jaw and an opening, a transverse slot communicating between said opening and said transverse sliding hole, two pivot holes at two opposite sides of said opening;

said movable jaw has a fixed cylindrical coupling portion moved in the transverse sliding hole of said handle, and a recessed hole at the periphery;

said release and constraint control mechanism comprises a pivot turned in the pivot holes of said handle, a cylindrical control member fixedly mounted around said pivot within the opening of said handle and having a longitudinal groove at the periphery and two longitudinal finger ribs raised from the periphery at two opposite sides and adapted for turning by fingers, a spring mounted in (a recessed hole of said handle) and a steel ball supported on said spring and forced by it into engagement with the periphery of said cylincrical control member to stop said movable jaw in position, said steel ball being moved into the longitudinal groove of said cylindrical control member when said cylindrical control member is turned relative to the cylindrical coupling portion of said movable jaw, causing said movable jaw to be released from said cylindrical control member for moving by hand relative to said fixed jaw.

* * * * *